United States Patent [19]

Gmünder

[11] Patent Number: 4,484,744

[45] Date of Patent: Nov. 27, 1984

[54] TOY FOR ARRANGING SLIDABLE ELEMENTS IN VARIOUS PATTERNS

[75] Inventor: Bruno Gmünder, Seon, Switzerland

[73] Assignee: Imag-Verlags Ag Für Immaterialgüterrecht, Zug, Switzerland

[21] Appl. No.: 460,231

[22] PCT Filed: Jun. 9, 1982

[86] PCT No.: PCT/CH82/00075

§ 371 Date: Jan. 19, 1983

§ 102(e) Date: Jan. 19, 1983

[87] PCT Pub. No.: WO82/04402

PCT Pub. Date: Dec. 23, 1982

[30] Foreign Application Priority Data

Jun. 18, 1981 [CH] Switzerland ..... 4024/81

[51] Int. Cl.[3] ..... A63F 9/08

[52] U.S. Cl. ..... 273/153 S

[58] Field of Search ..... 273/153 S, 281

[56] References Cited

U.S. PATENT DOCUMENTS

| | | | |
|---|---|---|---|
| 507,215 | 10/1893 | Churchill | 273/153 S |
| 3,564,735 | 2/1971 | Fisher | 273/157 R |
| 3,726,527 | 4/1973 | Schauffler | 273/241 X |

FOREIGN PATENT DOCUMENTS

| | | | |
|---|---|---|---|
| 81100092 | 10/1981 | Fed. Rep. of Germany | 273/153 S |
| WO82/00101 | 1/1982 | PCT Int'l Appl. | 273/153 S |
| 2088728 | 6/1982 | United Kingdom | 273/153 S |

*Primary Examiner*—Anton O. Oechsle

*Attorney, Agent, or Firm*—Karl F. Ross; Herbert Dubno

[57] ABSTRACT

A spherical body has three peripheral guide grooves, extending along orthogonally intersecting great circles, which are designed to retain respective sets of sliding elements with distinctive colors or other markings to be rearranged in certain patterns. The grooves are undercut and the sliding elements are removable therefrom as well as reinsertable into same upon separation of adjoining body segments which are snap-fitted together along the grooves.

4 Claims, 3 Drawing Figures

TOY FOR ARRANGING SLIDABLE ELEMENTS IN VARIOUS PATTERNS

FIELD OF THE INVENTION

My present invention relates to a toy for arranging slidable elements in various sequences of patterns.

BACKGROUND OF THE INVENTION

A toy of the type referred to has long been known in which several, usually 15, disks with numerical symbols can be slid in a frame of 4 by 4 squares, the object of the game being to organize the numerically mixed-up disks by sliding them crosswise and lengthwise in order to arrange them into a desired numerical pattern.

The disadvantage of such a toy lies in the relatively narrow range of possibilities of the selection of the patterns and the way these patterns can be made.

OBJECT OF THE INVENTION

It is the object of my invention to provide a toy of the foregoing type in which a multiplicity of possible combinations can be achieved and which should, in addition, be robust and handy.

SUMMARY OF THE INVENTION

I realize this object, in accordance with the present invention, by providing a spherical body with a plurality of orthogonally intersecting guide grooves, extending along great circles of the body, wherein differently marked elements, in the form of pegs or the like, are freely slidable. These elements advantageously have rounded heads projecting above the surface of the body for convenient manipulation.

Such a toy is of didactic value and, depending on the number of guide grooves and elements placed therein, enables the establishment of a wide variety of patterns. By suitable selection of ball diameter and choice of material, possibly including precious metals, the device can be made easy to handle and friendly to the touch for psychomotor-behavior training.

In general, it is sufficient to provide the ball-shaped body of the device with two intersecting great-circle grooves; this already affords a large number of possible combinations with only two groups of differently marked sliding pegs. However, with these grooves and a greater number of differently marked sliding pegs more numerous combination possibilities will exist.

Thus, I prefer—not only for the sake of a sufficient number of possible combinations but also from the viewpoint of a rational manufacture—to provide the ball-shaped body of the device with three intersecting great-circle grooves separating it into eight equal segments.

For the selective insertion of differently marked sliding elements, as well as for a quick re-establishment of a desired pattern after excessive confusion through a shifting of these elements, the segments delineated by the intersecting grooves can be detachably interconnected. For this reason it is advantageous if the segments of the ball are held together by means of snap fasteners.

Although, basically, only a few sliding elements have to be provided in order to satisfy the rules of the game, it is advisable—and heightens the fascination of the game—if each groove is completely occupied by a multiplicity of such elements adjoining one another over the entire periphery of the ball.

Furthermore, the sliding elements can have different types of markings, e.g. numerals, ornaments or letters. Preferably, however, these elements are marked with different colors assigned to respective groups of them, as may be desired.

BRIEF DESCRIPTION OF THE DRAWING

The above and other features of my invention will now be described in detail with reference to the accompanying drawing in which.

SPECIFIC DESCRIPTION

Figure 1:
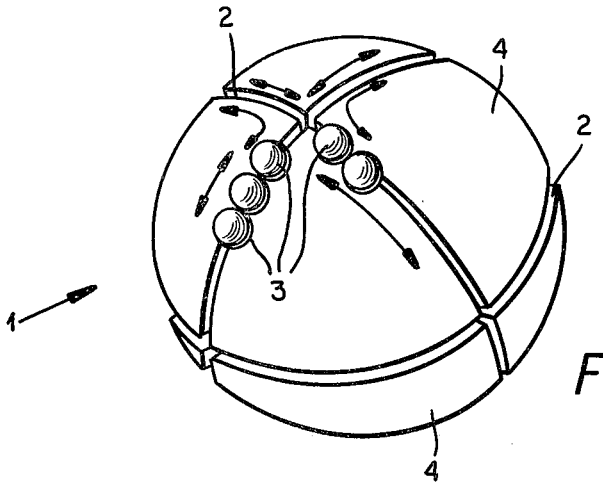
FIG. 1 is a perspective view of a device according to the invention.

The device shown in FIG. 1 comprises a spherical body 1 which, in this case, has three intersecting grooves 2 lying in mutually orthogonal planes that pass through the center of the body. The grooves 2, extending along great circles, divide the ball 1 into eight equal segments or octants 4.

In the grooves 2 a number of slidable elements 3 are guided that partly overlap the surface of the ball and can consequently be moved with one finger along these grooves.

For reasons of clarity, FIG. 1 shows only three and two slidable elements 3 in respective grooves 2 whereas, actually, each groove 2 can be completely occupied by a multiplicity of closely adjoining elements 3. Consequently there are three circular rows of such elements on the periphery of the ball; the elements 3 located in a groove crossing can be moved in one or the other orthogonal plane. If, then, the slidable elements of each circular row are of a distinct color, an immense number of possible combinations are available. The aim of the player is to rearrange the mixed-up colored elements so as to form again three circular rows of elements each consisting of a distinct color. Thus, the game becomes more difficult if, for instance, each groove quadrant bounding a segment is filled with slidable elements of a distinct color.

Figure 2:
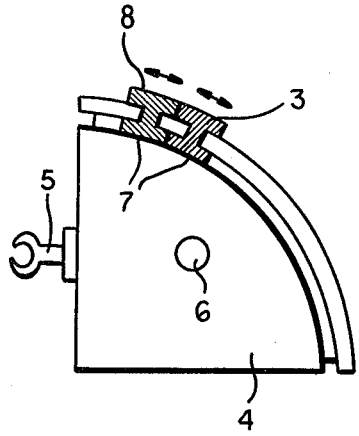
FIG. 2 is a side view of a segment of the device shown in FIG. 1.

As can be seen in FIGS. 1 and 2, the ball segments or octants 4 delineated by the grooves 2 are detachably joined together; this simplifies manufacture and, moreover, heightens the value of the game. In this connection it is advantageous to interconnect the ball segments 4 by snap fasteners such as clips 5 which engage in confronting holes 6. Separation of the segments enables elements 3 to be removed from and reinserted in the grooves 2.

However, I may use other means for connection such as, for example, a bayonet catch.

The body 1, the slidable elements 3 and the clips 5 may, in principle, consist of a variety of materials, e.g. wood, clay, metal or plastics.

Moreover, there are many possibilities for the shapes of the slidable elements 3 and the great-circle grooves 2.

According to FIG. 2, the slidable elements 3 have cross-sections in the form of a double-T with preferably spherically curved sliding surfaces 7 and outer surfaces 8.

The cross-section of the guide grooves 2 is of inverted-T shape as will be apparent when the octant 4 of FIG. 2 is considered juxtaposed with a neighboring octant separated therefrom by the base of its male fastener 5.

Figure 3:
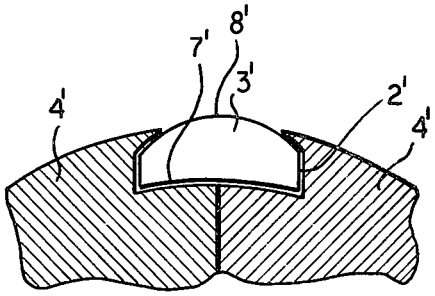
FIG 3 is a fragmentary sectional view drawn to a larger scale and showing a variation of a detail of the device according to FIGS. 1 and 2.

In FIG. 3 I have shown a slidable element 3' which is a centrally symmetrical peg with a spherically concave sliding surface 7' and convex outer surface 8'; the corresponding groove is of approximately dovetailed cross-section. In this instance, as in the preceding one, the grooves are undercut for positive retention of the slidable elements.

From the foregoing description it can be seen that I have provided an instrument for play, training and entertainment which will satisfy the highest requirements and will be a great challenge to every user.

I claim:

1. A toy comprising:

a spherical body with a plurality of intersecting peripheral grooves extending along respective great circles thereof in mutually orthogonal planes, said body being divided into separable segments by said grooves and being provided with fastening means for holding said segments together; and a multiplicity of differently marked elements slidable in said grooves and insertable into same upon separation of said segments from one another, said grooves being undercut for positively retaining said elements therein.

2. A toy as defined in claim 1 wherein said elements have heads projecting above the surface of said body.

3. A toy as defined in claim 1 wherein the number of said grooves is three whereby said body is divided into eight mutually symmetrical segments.

4. A toy as defined in claim 1 wherein said fastening means comprises spring clips on certain segment surfaces receivable in holes on confronting segment surfaces.

* * * * *